US005276457A

United States Patent [19]

Agarwal et al.

[11] Patent Number: 5,276,457

[45] Date of Patent: Jan. 4, 1994

[54] INTEGRATED ANTENNA-CONVERTER SYSTEM IN A UNITARY PACKAGE

[75] Inventors: Krishna Agarwal; Donald F. Shea, both of Plano, Tex.

[73] Assignee: E-Systems, Inc., Dallas, Tex.

[21] Appl. No.: 835,490

[22] Filed: Feb. 14, 1992

[51] Int. Cl.[5] ..... H01Q 1/42

[52] U.S. Cl. ..... 343/789, 700MS, 772, 786, 776, 841, 774, 705, 777, 778, 784

[58] Field of Search ..... 343/789, 700MS, 772, 786, 776, 841, 774, 705, 777, 778, 784

[56] References Cited

U.S. PATENT DOCUMENTS

| | | | |
|---|---|---|---|
| Re. 32,369 | 3/1987 | Stockton et al. | 343/700 MS |
| 3,312,976 | 4/1967 | Gregory | 343/770 |
| 3,701,161 | 10/1972 | Gregory | 343/770 |
| 3,864,687 | 2/1975 | Walters et al. | 343/778 |
| 4,251,817 | 2/1981 | Kimura et al. | 343/700 MS |

*Primary Examiner*—Donald Hajec

*Assistant Examiner*—Hoanganh Le

*Attorney, Agent, or Firm*—Harold E. Meier

[57] ABSTRACT

Monolithic microwave integrated circuit (MMIC) technology is advantageously used to fabricate microwave circuitry for an antenna-converter system to enable an antenna and its associated converter circuits to be integrated together into a unitary package. Small reliable radio frequency (RF) circuits, polarization switch matrix circuits, intermediate frequency (IF) circuits and power and control circuits for the converter are manufactured and integrated onto a plurality of small area microwave circuit disks using MIC/MMIC technology. The plurality of converter circuit disks are sandwiched together and directly mounted flat against the back of the antenna to form a unitary package. The disks for the converter circuits are further sized such that the circuit disks fit within an envelope volume defined by the size and shape of the antenna.

15 Claims, 3 Drawing Sheets

INTEGRATED ANTENNA-CONVERTER SYSTEM IN A UNITARY PACKAGE

TECHNICAL FIELD

The present invention relates to the packaging of antennas and associated converter circuits and, in particular, to an integrated antenna-converter system implemented in a unitary package by fabricating the converter circuits using microwave integrated circuit and monolithic microwave integrated circuit technologies on a plurality of substrates mounted directly to the back of the antenna.

BACKGROUND OF THE INVENTION

Conventionally, an antenna and the various components of its associated converter circuitry (such as radio frequency receivers, polarization switch matrix circuits, intermediate frequency receivers and power and control circuits) were each designed as separate packages. The distinct, separate packages of the antenna-converter system were then interconnected with each other to form an assembled antenna-converter system through the use of cables and connectors. This conventional assembly method, however, has proven to provide unsatisfactory performance for several reasons. For example, the use of cables and connectors for interconnecting the separate antenna and converter packages often results in degraded system performance due to signal losses in the cables and decreased system reliability. Furthermore, the use of separate packages for the antenna and various converter circuits increases the required size and overall weight of the antenna-converter system.

SUMMARY OF THE INVENTION

The antenna-converter system of the present invention advantageously utilizes microwave integrated circuit (MIC) and monolithic microwave integrated circuit (MMIC) technologies to fabricate the various converter circuits on a plurality of substrates mounted directly to the antenna. This integrates the antenna with the associated converter circuits to form a unitary package that is smaller, lighter and more reliable than the conventional antenna-converter system assembly. Such an integrated antenna-converter system is preferred for use in space and weight conscious applications such as military aircraft and spacecraft.

In particular, MIC/MMIC design techniques enable small reliable radio frequency (RF) circuits to be manufactured and integrated together with fewer interconnects in a relatively small area such as a disk. Polarization switch matrix circuits, intermediate frequency (IF) circuits and power and control circuits are similarly manufactured an integrated together onto small disks. The plurality of converter circuitry disks are then aligned, sandwiched together and mounted directly to the back of the antenna to form the unitary antenna-converter package. Electrical connections between the antenna and various MMIC disks for the converter circuits are established using right angle coax-to-microstrip transitions. An included connector couples the unitary antenna-converter package to external power supplies, control circuits and processors.

BRIEF DESCRIPTION OF THE DRAWINGS

A more complete understanding of the integrated antenna-converter in a unitary package of the present invention may be had by reference to the following Detailed Description when taken in conjunction with the accompanying Drawings wherein.

DETAILED DESCRIPTION OF THE DRAWINGS

Figure 1:
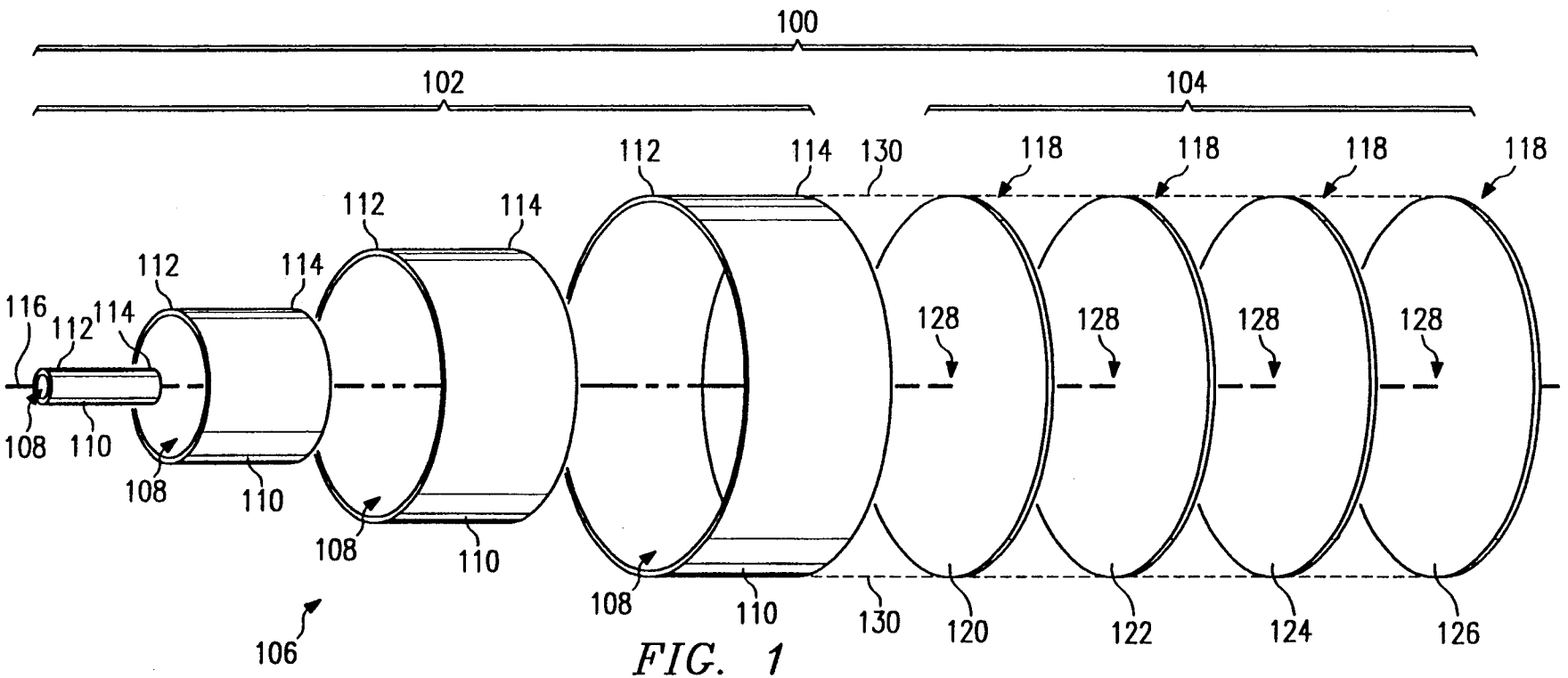
FIG. 1 is an exploded schematic view of the integrated antenna-converter in a unitary package of the present invention.

Reference is now made to FIG. 1 wherein there is shown an exploded schematic view of the integrated antenna-converter in a unitary package 100 of the present invention. The unitary package 100 is comprised generally of an antenna section 102 integrated with, and mounted to a converter section 104 in a manner to be described The antenna section 102 contains the hardware required for receiving and generating electromagnetic waves carrying electromagnetic signals in one or more predetermined frequency ranges. The converter section 104 contains the circuitry required for implementing the radio frequency, intermediate frequency, polarization switch matrix and power-control circuits associated with receiving, generating and processing electromagnetic signals received and output by the antenna section 102 in the form of propagating electromagnetic waves.

Figure 3:
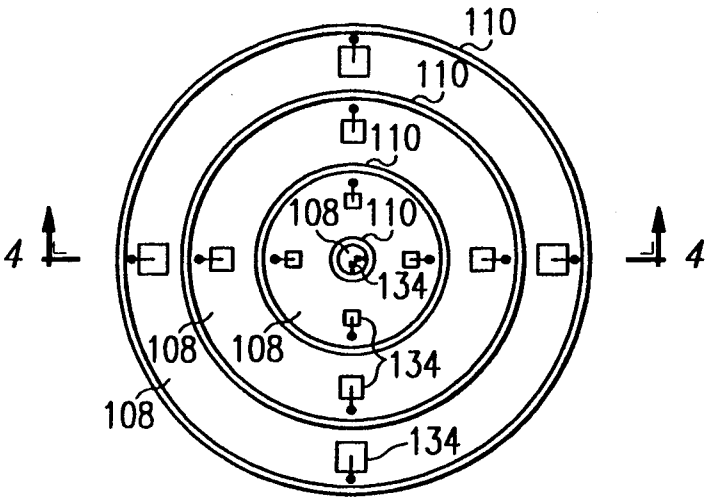
FIG. 3 is a front view of the coaxial waveguide antenna utilized in the unitary antenna-converter package of the present invention.

The antenna section 102 is preferably a multi-cavity coaxial waveguide antenna 106 having a plurality of cavities 108 each sized for propagating electromagnetic waves in a different range of frequencies. The cavities 108 are defined by a plurality of conductive cylinders 110, each having an open end 112 and a closed end 114 (see also FIG. 4). Multiple, sized cavities 108 form an antenna 106 capable of operation over multiple frequency ranges. The conductive cylinders 110 are concentrically positioned with respect to each other to share a common axis 116. Each closed end 114 of a conductive cylinder 110 for the coaxial waveguide antenna 106 is terminated by a shared conductive plate and a plurality of probes (shown in FIGS. 3 and 4). The probes generate and receive, in the cavities 108, electromagnetic signals in the form of electromagnetic waves propagating in the frequency range dictated by the size of the cavity. It will, of course, be understood that the antenna section 102 may include only a single cavity 108 for propagating electromagnetic signals in a single frequency range, or have a different waveguide shape (for example, multi-cavity rectangular), if desired.

With the advent of monolithic microwave integrated circuit (MMIC) manufacturing techniques, it has become possible to integrate the necessary circuits for the converter section 104 of an antenna-converter system on one or more small area substrates 118 (for example, the circuit disks shown in FIG. 1). Such fabrication of integrated microwave circuits enables the circuit designs implemented on each disk substrate 118 to be connected to each other and to other disks with a fewer number of interconnects than with conventional signal degrading, RF cable interconnect designs. Furthermore, interconnection of the disks 118 provides a circuit package containing all necessary converter circuits occupying a relatively small volume. In the antenna converter implementation disclosed herein, MIC/MMIC fabrication allows for integration of all necessary circuits of a radio frequency feed network for the converter section 104 on a single small area feed network disk 120. Polarization switch matrix control circuits, intermediate frequency converters, and power and control circuits for the converter section 104 are similarly capable of integration on a polarization switch matrix disk 122, intermediate frequency disk 124 and power and control circuit disk 126, respectively.

Each MMIC implemented disk 120–126 has a center 128 that is aligned with the axis 116 for the plurality of concentric cylinders 110 comprising the coaxial cavity antenna 106. The concentric cylinders 110 and disks 118 of the antenna section 102 and converter section 104 as shown in FIG. 1 are assembled along axis 116 with the disks of the converter section 104 sandwiched together and mounted directly to, and flat against the back of the antenna section 102 to fabricate the integrated antenna-converter in a unitary package 100 shown in FIG. 2. Furthermore, with MMIC implementation of the circuits, the circular area provided for each disk substrate 118 is chosen such that the perimeter of the substrate does not extend outside an envelope, shown generally by broken lines 130, for the antenna section 102. The envelope 130 is an imaginary volume extending in a rearward direction from the back of the antenna. The size and shape of the envelope 130 is dictated by the size and shape of the outer surface of the antenna section 102. With a coaxial antenna 106 as shown, the envelope 130 is a cylindrical volume defined by the outer surface of the outermost concentric cylinder 11? . It is within this cylindrical volume that the sandwiched disk substrates 118 for the converter circuit section 104 must fit to form the unitary package. A connector 132 is provided to feed power and control signals to the converter circuit disks 120–126 to enable operation of the unitary antenna-converter package 100.

Figure 4:
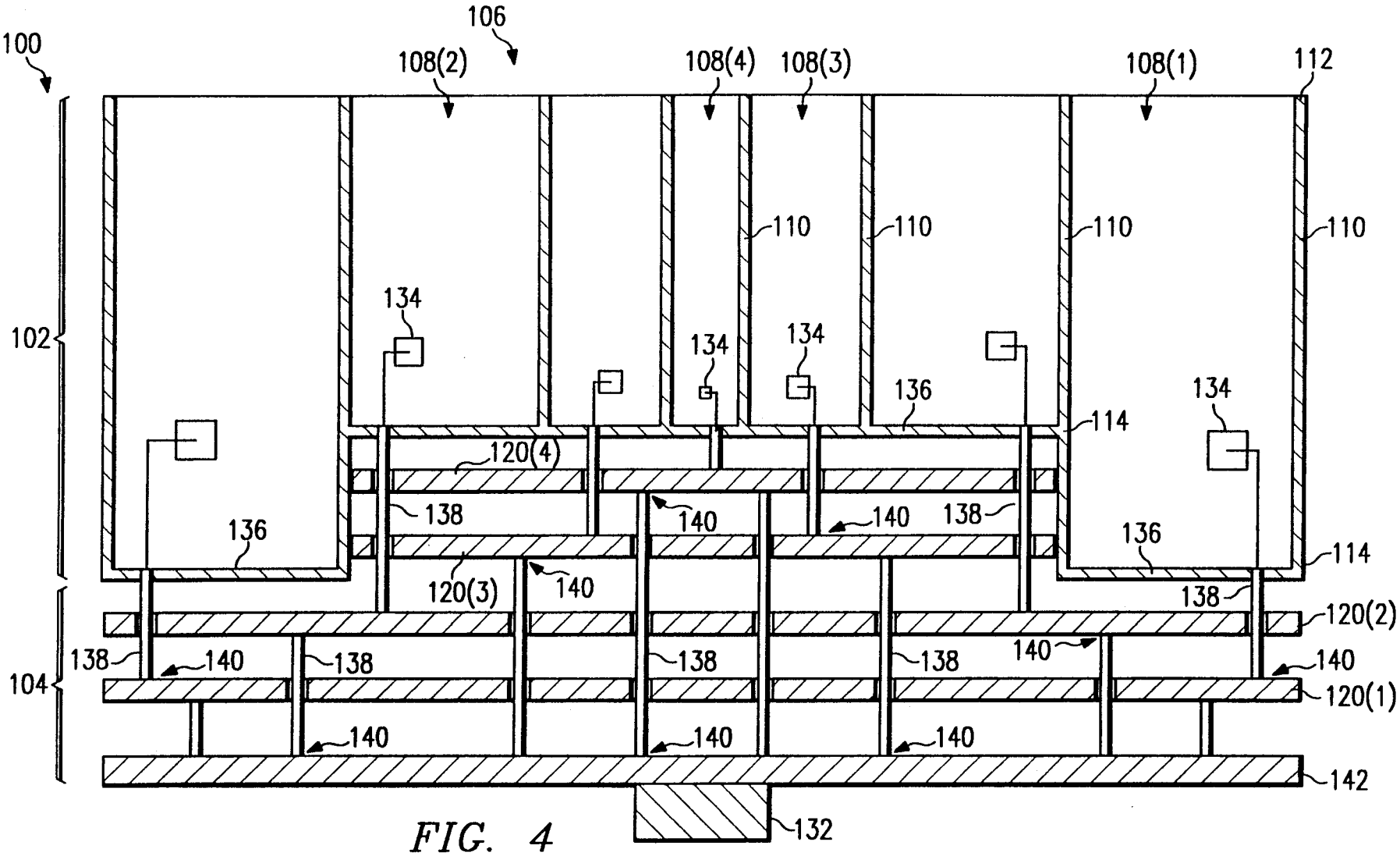
FIG. 4 is a side cross-sectional view of the integrated coaxial waveguide antenna and converter circuit disks of the unitary antenna-converter package of the present invention.

Reference is now made to FIG. 4 wherein there is shown a side cross-sectional view of the integrated antenna-converter in a unitary package 100 of the present invention. The antenna section 102 of the package 100 is a coaxial waveguide antenna 106 comprised of a plurality of concentric conductive cylinders 110, each cylinder having an open end 112 and a closed end 114. The termination for the closed end 114 of the assembled concentric cylinders 110 is a conductive plate 136. The size of each cavity 108 of the antenna 106 is selectively chosen to propagate electromagnetic waves in a predetermined range of frequencies. For example, in the embodiment shown in FIG. 4, the sizes of the cavities are selected such that cavity 108(1) operates over the 2–3.5 GHz range, cavity 108(2) over the 3.5–6 GHz range, cavity 108(3) over the 6–10 GHz range and cavity 108(4) over the 10–18 GHz range. The embodiment shown is thus capable of operation over a broad range of frequencies from two to eighteen gigahertz.

Figure 2:
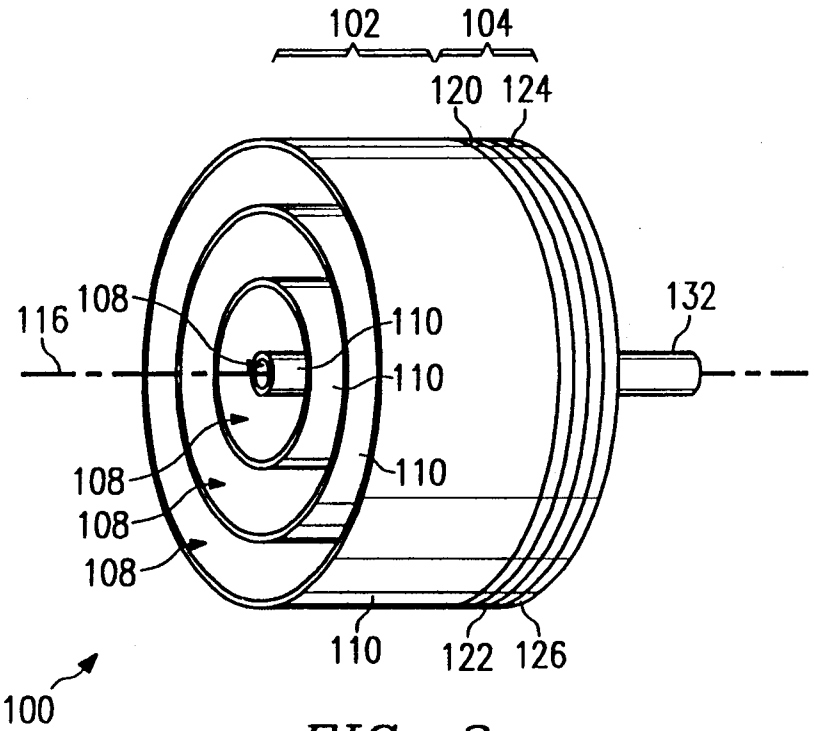
FIG. 2 is an assembled view of the unitary antenna-converter package as shown in FIG. 1.

The probes 134 at the closed end of each cavity 108 receive and radiate electromagnetic waves only in the frequency range dictated by the size of the cavity. To process the electromagnetic signals received by the probes 134 or generate a signal for radiation by the probes, the probes associated with each cavity 108(1)–108(4) are connected to a separate feed network disk 120(1)–120(4), respectively. Each feed network disk 120 contains circuits designed to operate over the frequency range for the cavity 108 electrically coupled thereto. Thus, each feed network disk 120 includes MMIC implemented modulation and demodulation circuitry (including a radio frequency converter and several sub-bands of a converter). It will, of course, be understood that the requisite radio frequency converter circuits for all operating frequencies of the antenna section 102 may be MMIC implemented on a single disk 120, as shown in FIGS. 1 and 2, if the area needed for the circuits results in a disk size that fits within the volume of the antenna envelope 130 (see FIG. 1) when mounted to the back of the antenna.

The connection between each antenna cavity 108 and associated feed network disk 120 is made using a short piece of coaxial line 138 with the inner and outer coaxial conductors at one end connected to the probe 134 and plate 136, respectively. At the other end of the line 138, the inner and outer conductors are connected to a microstrip line on the feed network disk 120 using a right angle coax-to-microstrip transition (generally indicated at 140). When the microwave circuits on the disks are implemented with striplines, similar interconnect methods may be used. The converter section 104 further includes polarization switch matrix circuits, intermediate frequency converter circuits and power and control circuits implemented on one or more disks 142 using MIC/MMIC technology. The connections between the feed network disks 120 and the remaining converter disk(s) 142 are made using short pieces of coaxial line 138 with the ends of the line connected to the microstrip lines of each disk using right angle coax-to-microstrip transitions 140. Connections between the various disks utilized in the converter section 104 and external power supply, command and control, and processing circuits may be made via a connector 132 and/or a coaxial line 138 as desired or needed.

Although a preferred embodiment of the integrated unitary antenna-converter package has been described in the foregoing Detailed Description and illustrated in the accompanying Drawings, it will be understood that the invention is not limited to the embodiment disclosed, but is capable of numerous rearrangements, substitutions and modifications without departing from the spirit of the invention.

We claim:

1. An integrated antenna-converter, comprising:

an antenna section having means for receiving and radiating electromagnetic signals in the form of electromagnetic waves;

a converter circuit section including means for processing electromagnetic signals, the circuit section implemented on at least one circuit board electrically connected to the means for receiving and radiating electromagnetic signals, wherein the at least one circuit board for the converter circuit section directly mounts to the antenna section to fabricate, in a unitary package, an integrated antenna-converter; and polarization matrix switch means comprising a circuit board for the converter circuit section, the circuit board for the polarization matrix switch means mounted to at least one circuit board for the converter circuit section and mounted to the antenna section to fabricate, in a unitary package, an integrated antenna-converter.

2. The antenna-converter apparatus as in claim 1 wherein the means for receiving and radiating electromagnetic signals comprises a plurality of electromagnetic probes.

3. The antenna-converter apparatus as in claim 1 wherein the antenna section has a configuration that defines an antenna envelope extending away from a back side of the antenna section and wherein the at least one circuit board for the converter circuit section mounted to the antenna section fits within the defined antenna envelope.

4. The antenna-converter apparatus as in claim 1 further comprising:

intermediate frequency circuit means comprising a circuit board electrically connected to the circuit board for the polarization matrix switch means, the circuit board for the intermediate frequency circuit means mounted to the circuit boards for the polarization matrix switch means and the converter circuit section and mounted to the antenna section to fabricate, in a unitary package, an integrated antenna-converter.

5. The antenna-converter apparatus as in claim 4 further comprising:

power and control circuit means comprising a circuit board electrically connected to the circuit board of the intermediate frequency circuit means, the circuit board for the power and control circuit means mounted to the circuit boards for the intermediate frequency circuit means, the polarization matrix switch means and the converter circuit section and mounted to the antenna section to fabricate, in a unitary package, an integrated antenna-converter.

6. An integrated antenna-converter, comprising:

an antenna section having means for receiving and radiating electromagnetic signals in the form of electromagnetic waves, said antenna section comprising a waveguide antenna having a plurality of waveguide cavities, each propagating electromagnetic signals in a predetermined frequency range; and a converter circuit section including means for processing electromagnetic signals, the circuit section implemented on at least one circuit board electrically connected to the means for receiving and radiating electromagnetic signals, wherein the at least one circuit board for the converter circuit section directly mounts to the antenna section to fabricate, in a unitary package, an integrated antenna-converter.

7. The antenna-converter apparatus as in claim 6 wherein the waveguide antenna further includes a plurality of concentric conductive hollow cylinders terminates at one end by a conductive plate, wherein at least one circuit board for the converter circuit section mounts to the conductive plate of the waveguide antenna.

8. The antenna-converter apparatus as in claim 7 wherein the means for receiving and radiating electromagnetic signals comprising:

a plurality of electric field probes positioned within each cavity of the waveguide antenna at the end terminated by the conductive plate.

9. An integrated antenna-converter, comprising:

a waveguide antenna having a plurality of cavities terminated at one end, each cavity having a predetermined size for propagation of electromagnetic signals in a predetermined frequency range;

a plurality of electromagnetic probes for each cavity of the antenna for receiving and radiating electromagnetic signals in the predetermined frequency range of the individual cavities; and converter circuit means comprising a plurality of circuit boards electrically coupled to the plurality of electromagnetic probes to generate and process electromagnetic signals in the predetermined frequency ranges propagated by the plurality of cavities and physically mounted together and to the terminated one end of the antenna to fabricate a unitary antenna-converter package.

10. The antenna-converter as in claim 9 wherein the waveguide antenna has a size and shape that defines an antenna envelope extending away from the terminated end of the antenna, and wherein each circuit board has a perimeter that fits within the defined antenna envelope when mounted to the end of the antenna.

11. The antenna-converter as in claim 9 wherein the waveguide antenna comprises a coaxial waveguide cavity antenna having a plurality of concentric conductive hollow cylinders closed at one end to define a plurality of cavities with the plurality of electromagnetic probes positioned within said cavities at the closed end thereof.

12. The antenna-converter as in claim 9 wherein each circuit board of the converter circuit means comprises a monolithic microwave integrated circuit with each electromagnetic probe connected to the converter circuit means on a circuit board by means of a coaxial line extending between the cavity and the circuit board.

13. An integrated antenna-converter, comprising:

a waveguide antenna having a plurality of cavities each having a predetermined size for propagating microwave electromagnetic signals in a predetermined frequency range, the waveguide antenna further having a shape defining an antenna envelope extending in a rearward direction away from a back side of the waveguide antenna;

a plurality of electromagnetic probes for each cavity of the waveguide antenna for receiving and radiating microwave electromagnetic signals in the predetermined frequency range of individual cavities; and microwave converter circuit means electrically connected to the plurality of electromagnetic probes for processing and generating microwave electromagnetic signals, said circuit means comprising monolithic microwave circuit boards that are mounted together and mounted directly to the back side of the antenna within the antenna envelope to fabricate a unitary antenna-converter package.

14. The antenna-converter package as in claim 13 wherein the waveguide antenna comprises a coaxial conductive hollow cylinders closed at one end to define the plurality of cavities, an outermost one of the concentric conductive cylinders having a surface defining the the antenna envelope.

15. The antenna converter as in claim 13 wherein each circuit board has a perimeter defining an area that fits within the antenna envelope when mounted to the back side of the antenna.

* * * * *